US007931381B2

(12) United States Patent
Balbinotti et al.

(10) Patent No.: US 7,931,381 B2
(45) Date of Patent: Apr. 26, 2011

(54) LIGHTING SYSTEM FOR COOKING APPLIANCE

(75) Inventors: Pedro Balbinotti, Joinville (BR); Leopoldo Zandardo Franca, Joinville (BR); Ramiro Ruthes Junior, Joinville (BR); Foad Mobini Kesheh, Joinville (BR); Vinicius Menezes Rodovalho, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 248 days.

(21) Appl. No.: 12/339,187

(22) Filed: Dec. 19, 2008

(65) Prior Publication Data

US 2010/0154774 A1 Jun. 24, 2010

(51) Int. Cl.
*F21V 33/00* (2006.01)

(52) U.S. Cl. ..... 362/92; 219/758

(58) Field of Classification Search ..... 362/92–94; 219/758

See application file for complete search history.

(56) References Cited

U.S. PATENT DOCUMENTS

| | | | | |
|---|---|---|---|---|
| 4,326,243 | A | 4/1982 | Pistor et al. | |
| 4,853,508 | A | 8/1989 | Hammerl | |
| 4,870,546 | A | 9/1989 | Hammerl et al. | |
| 4,880,955 | A | 11/1989 | Nitzinger et al. | |
| 6,361,181 | B1 | 3/2002 | Bales | |
| D493,559 | S * | 7/2004 | Park | D26/74 |
| D493,906 | S * | 8/2004 | Park | D26/74 |
| 7,188,618 | B2 | 3/2007 | Anschutz et al. | |
| 2005/0122709 | A1 * | 6/2005 | Ha | 362/92 |

FOREIGN PATENT DOCUMENTS

EP 783240 A2 * 7/1997

* cited by examiner

*Primary Examiner* — Robert May

(74) *Attorney, Agent, or Firm* — Tara M. Hartmann; Diederiks & Whitelaw PLC

(57) ABSTRACT

A lighting unit for use in illuminating an oven cavity is internally, asymmetrically constructed and externally, substantially symmetrically constructed. Due to the symmetrical external construction, the lighting unit can be readily mounted in an oven cavity in multiple configurations to establish varying levels of illumination depending on the selected mounting arrangement. In particular, the lighting unit can be rotated prior to insertion in a side wall opening of the oven cavity, with the illumination intensity varying depending on the selected mounting position. In one preferred embodiment of the invention, the outer shell is rectangular in shape to establish two distinct, potential mounting positions upon rotation of the lighting unit 180°, with the level of illumination varying in the order of at least 45% between the two mounting positions.

12 Claims, 3 Drawing Sheets

LIGHTING SYSTEM FOR COOKING APPLIANCE

BACKGROUND OF THE INVENTION

1. Field of the Invention

The present invention pertains to the art of cooking and, more particularly, to a lighting system employed in a cooking appliance.

2. Description of the Related Art

Many cooking appliances incorporating oven cavities are provided with doors including transparent portions which enable a user to view the progress of a cooking operation without requiring the door to be opened, thereby avoiding the consequential loss of heat. In addition, it is commonplace for the cooking appliance to include a light in the oven cavity to enable the oven cavity to be selectively illuminated in order to enhance the user's ability to accurately view the food being cooked. Typically, one or more fixed lights are provided in an oven cavity for this purpose, with a control panel of the cooking appliance including a button or switch for selectively turning the light(s) on or off.

Although the shape and structure of lighting units used in oven cavities of cooking appliances can vary, particularly depending on the size and configuration of a given oven cavity, each lighting unit or fixture employed has a set intensity level determined by the appliance manufacturer. Therefore, consumers are not able to alter the available light intensity, at least unless the appliance includes electrical circuitry enabling the lighting unit to receive adjustable current levels. Instead, essentially universally, a consumer will make a purchase based on other characteristics of the appliance and the available lighting intensity is not a variable option. For manufacturers, altering the available level of illumination in an oven cavity has meant employing different lighting fixtures. As the need to have different lighting fixtures available for a given assembly line is not particularly economical, manufacturers have simply predetermined a reasonable intensity for a given oven cavity and used a set lighting fixture to achieve that single level of illumination. Unfortunately, such an arrangement provides for only limited design flexibility and lacks any versatility without adding considerably to the overall cost of the appliance.

SUMMARY OF THE INVENTION

The present invention is directed to providing a lighting unit or fixture for use in illuminating an oven cavity wherein the lighting unit is internally, asymmetrically constructed, yet externally, substantially symmetrically constructed. Due to the symmetrical external construction, the lighting unit can be readily mounted in an oven cavity in multiple configurations. Due to the asymmetrical internal configuration, the level of illumination provided in the oven cavity will differ depending on the selected mounting arrangement. Therefore, such an arrangement enables a single lighting unit to provide different illumination intensities depending on the manner in which the lighting unit is mounted in the oven cavity.

In a preferred embodiment of the invention, the lighting unit includes an outer shell having various side tabs which enable the lighting unit to be snap-fittingly retained in an opening provided in a wall of an oven cavity. Regardless of the particular mounting arrangement employed, the outer shell can take various symmetrical shapes, including a wide range of polygonal shapes so as to take the form of a square, a rectangle, an equilateral triangle, a hexagon, an octagon and the like. With this arrangement, the lighting unit can be rotated prior to insertion in the side wall opening, with the exhibited illumination intensity varying depending on the selected mounting position. In one preferred embodiment of the invention, the outer shell includes an external body portion which is rectangular in shape such that the lighting unit can be selectively mounted in two distinct positions upon rotation of the lighting unit 180°, with the level of illumination varying in the order of 45% between the two mounting positions.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
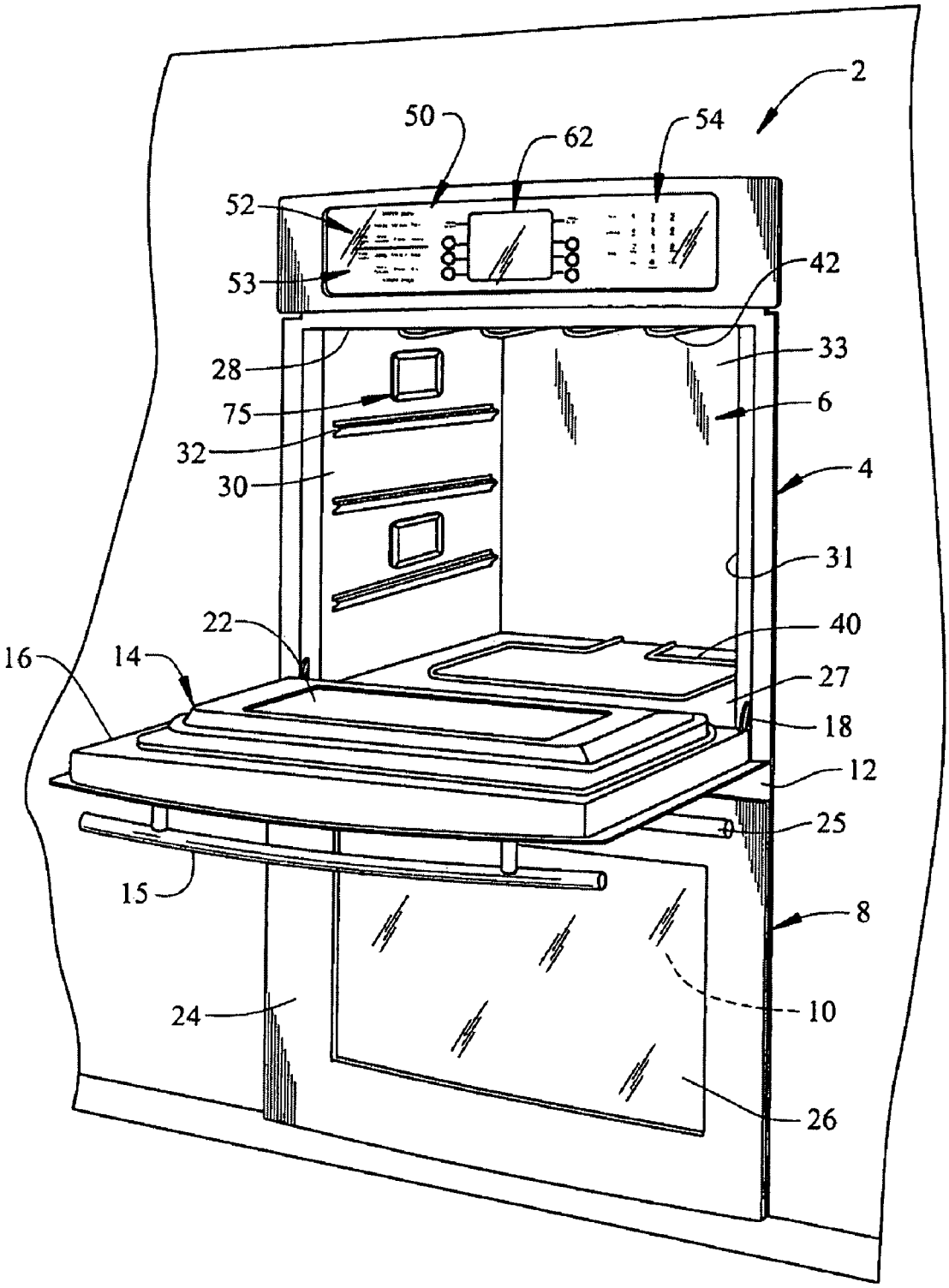
FIG. 1 is a perspective view of a wall oven including an oven cavity containing a lighting system in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. More specifically, in the embodiment depicted, both bake element 40 and top broiler element 42 are constituted by sheathed electric resistive heating elements. Based on the above, cooking appliance 2 actually constitutes an electric, dual wall oven. However, it is to be understood that cooking appliance 2 could equally operate on gas, either natural or propane.

As further shown in FIG. 1, cooking appliance 2 includes an upper control panel 50 having a plurality of control elements. In accordance with the illustrated embodiment, the control elements are constituted by first and second sets of oven control buttons 52 and 53, as well as a numeric pad 54. Control panel 50 is adapted to be used to input desired cooking parameters and, as will be discussed more fully below, input initial operating conditions for cooking appliance 2. More specifically, the first and second sets of control buttons 52 and 53, in combination with numeric pad 54 and a display 62, enable a user to establish particular cooking operations for upper and lower ovens 4 and 8 respectively.

Since various programming and general operation characteristics of cooking appliance 2 do not form part of the present invention, these features will not be discussed further here. In fact, the general construction and operation of cooking appliance 2 as described above is known in the art and has only been provided for the sake of completeness. Instead, the present invention is particularly directed to the lighting system employed for oven cavities 6 and 10, with the lighting system including one or more lighting units 75 mounted in oven cavities 6 and 10. As depicted in FIG. 1, oven cavity 6 is shown to include upper and lower lighting units 75 mounted in side wall 30. A corresponding set of lighting units 75 could also be mounted in side wall 31, or one or more lights could be provided on back wall 33. Actually, the exact number and location of lighting unit(s) 75 can vary without departing from the invention. Instead, it is the manner in which any particular lighting unit 75 is structured and mounted which forms the invention as detailed below.

Figure 2:
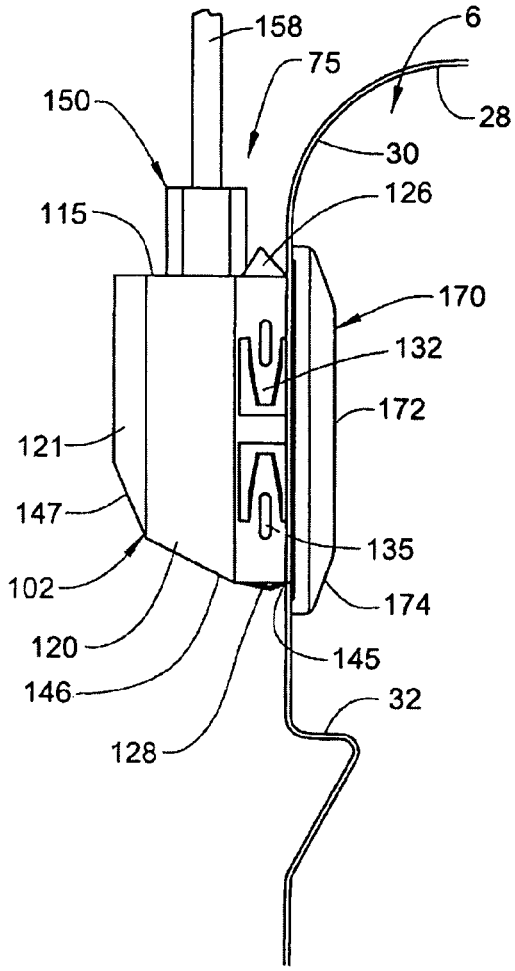
FIG. 2 is an enlarged, partial cross-sectional view of a portion of the oven cavity of FIG. 1 depicting a lighting unit in a first mounting position.
Figure 3:
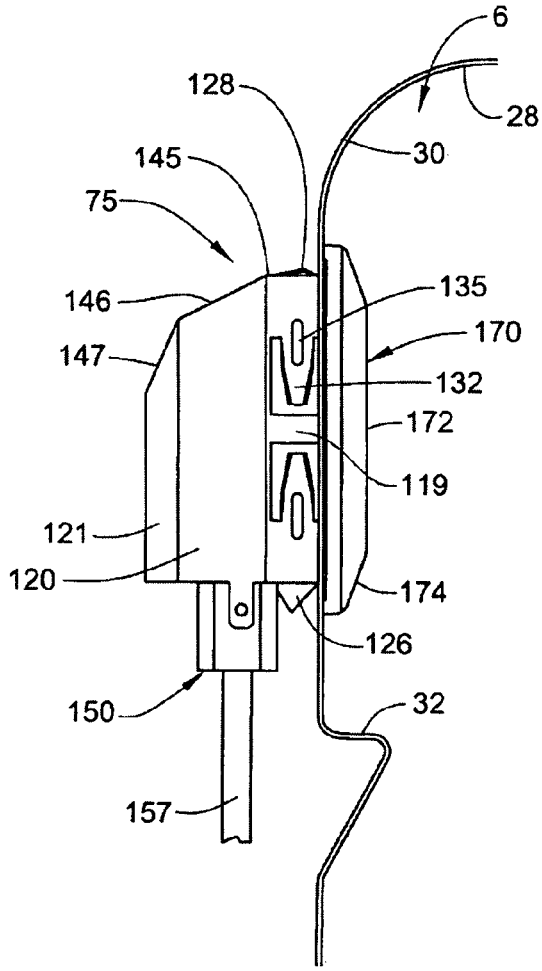
FIG. 3 is an enlarged, partial cross-sectional view similar to that of FIG. 2 but depicting the lighting unit in a second mounting position.
Figure 4:
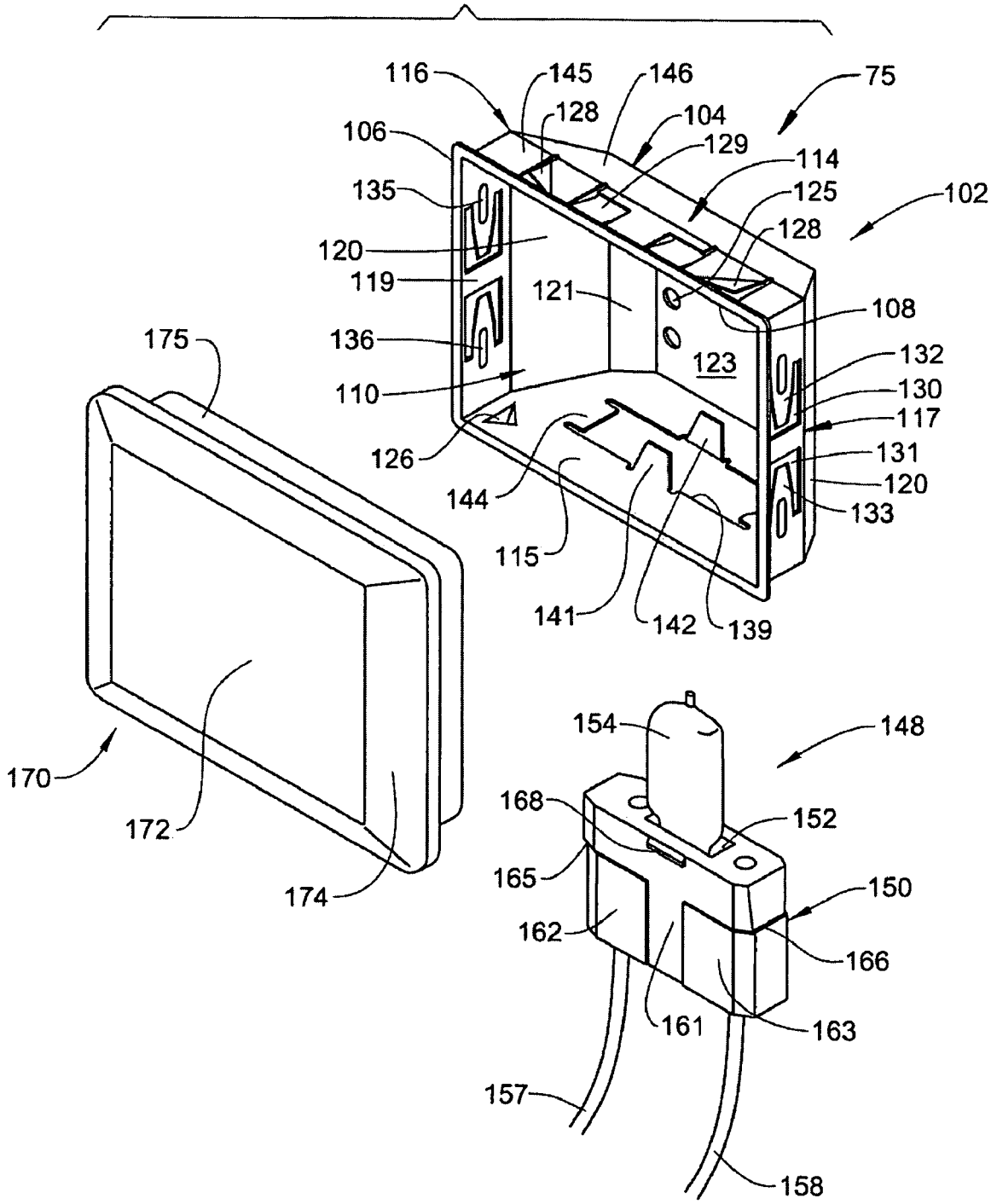
FIG. 4 is an exploded view of the lighting unit of FIGS. 2 and 3.

As shown in FIGS. 2-4, lighting unit 75 constructed in accordance with the preferred embodiment of the invention includes an outer housing or shell 102 defined by a main body 104 depicted as being generally rectangular in shape. In this embodiment, shell 102 is formed of metal, with main body 104 having an out-turned frontal rim 106 that defines an opening 108 leading into an internal cavity 110. Main body 104 and internal cavity 110 are defined by top, bottom and opposing side walls 114-117. More specifically, each of side walls 116 and 117 includes a first side wall portion 119 which extends substantially perpendicular to out-turned rim 106, a second side wall portion 120 which extends rearwardly and inwardly at an angle from first side wall portion 119, and a third side wall portion 121 which further extends rearwardly and inwardly, preferably at a sharper angle than second side wall portion 120. Furthermore, main body 101 and internal cavity 110 are also defined by a rear wall 123 shown to include various holes 125 which are provided for ventilation purposes.

As shown in these figures, bottom wall 115 of main body 104 is formed with a pair of spaced, lower appendages 126 generally adjacent to first side wall portions 119 of opposing side walls 116 and 117. In the preferred embodiment shown wherein shell 102 is made of metal, lower appendages 126 are punched-out from bottom wall 115 and, in the particular embodiment shown, are generally triangular in shape. With this arrangement, lower appendages 126 project away from bottom wall 115 as illustrated. Also provided as part of main body portion 104, preferably spaced along top wall 114, is a pair of upper appendages 128. Again, in the preferred embodiment, upper appendages 128 are punched-out of metal shell 102. As illustrated, appendages 128 are attached to main body 104 at a position spaced from frontal rim 106 and actually angle outwardly and forwardly towards frontal rim 106. Between the spaced upper appendages 128 is a pair of spaced, preferably stamped, flaps 129 which extend into internal cavity 110 as will be discussed more fully below.

As also clearly illustrated in these figures, each of opposing side walls 116 and 117 are provided with first and second cut-out portions 130 and 131 which define respectively cantilevered tabs 132 and 133. Also formed in opposing side walls 116 and 117 are a pair of inwardly extending, elongated nubs 135 and 136 which extend, at least partially, into cantilevered tabs 132 and 133 respectively. With this arrangement, nubs 135 and 136 extend into internal cavity 110 beyond first side wall portion 119 and are biased in this direction by cantilevered tabs 132 and 133 as discussed more fully below.

Formed in bottom wall 115 is an elongated opening 139. About opening 139, adjacent frontal rim 106 and rear wall 123 are a pair of fore-to-aft spaced projecting elements 141 and 142. In addition, based on the manner in which elongated opening 139 is cut-out, opening 139 defines a pair of inwardly projecting side elements 144. With this overall arrangement, it should be noted that lighting unit 75 is internally, asymmetrically constructed, yet externally, substantially symmetrically constructed. In particular, with respect to the internal asymmetry, top wall 114 includes a first wall portion 145 which extends from frontal rim 106 a distance equal to first side wall portion 119, a second wall portion 146 which extends toward rear wall 123 a distance equal to second side wall portion 120 while being angled downwardly and rearwardly as shown in FIGS. 3 and 4, and a third wall portion 147 (see FIGS. 2 and 3) extending at a greater angle to rear wall 123. Therefore, with respect to the asymmetrical construction, internal cavity 110 varies significantly with respect to the flatness of bottom wall 115 verses the angling of second wall portion 146 of top wall 114. On the other hand, at least first side wall portion 119 of main body 104 is symmetrical around opening 108 which becomes important in connection with the potential mounting of lighting unit 75 in connection with the invention as will be detailed more fully below.

As best shown in FIG. 4, lighting unit 75 also includes a lighting module 148 including a body portion 150 formed with a socket 152 which receives a replaceable light bulb 154. Extending from body portion 150 are electrical wires 157 and 158 for supplying electricity used to illuminate light bulb 154. Body portion 150 generally includes a first body portion 161 and side body portions 162 and 163. Each of side portions 162 and 163 define respective lips 165 and 166 at the junctures with first body portion 161. In addition, opposing sides of first body portion 161 are formed with central ledge members 168. With this construction, lighting module 148 is adapted to be mounted in elongated opening 139. More specifically, utilizing FIG. 4 as a reference, lighting module 148 would be inserted into opening 139 such that light bulb 154 is positioned in internal cavity 110, inwardly projecting side elements 144 engages with lips 165 and 166 and fore-to-aft spaced projecting elements 141 and 142 are initially deflected by the ledge members 168 and then snapped beneath ledge members 168 to secure lighting module 148 to shell 102. Basically, lighting module 148 is mounted within shell 102 after shell 102 is mounted to a respective side wall 30, 31.

Based on the construction of shell 102 as described above, the mounting of shell 102 to a select side wall 30, 31 is done by initially angling main body 104 and slipping main body 104 through an opening (not labeled) in the side wall 30, 31 until lower appendages 126 are arranged behind the side wall 30, 31. Thereafter, main body 104 can be rotated until upper appendages 128 extend past the side wall 30, 31 and snap there behind in order to retain shell 102 in a desired position.

Thereafter, lighting module 148 can be attached to main body 104. Finally, a transparent cover 170 of lighting unit 75 is mounted to shell 102 from within oven cavity 6. As best shown in FIG. 4, transparent cover 170 includes an exposed central portion 172 and a tapered peripheral portion 174. In addition, transparent cover 170 includes an inner body portion 175. Upon mounting, inner body portion 175 extends into internal cavity 110 of shell 102 and is engaged by both flaps 129 and elongated nubs 135 which are biased against recessed body portion 175, particularly by cantilevered tabs 132 and 133 in the case of nubs 135. In this manner, transparent cover 170 is securely, frictionally retained in position.

At this point, it should be understood that the particular construction of lighting unit 75 and the specific elements used in mounting lighting unit 75 to oven cavity 6 should not be considered a limiting a factor in connection with the present invention. Certainly, there is an abundance of ways in which lighting unit 75 can be constructed and mounted in accordance with the present invention. However, it is considered important that lighting unit 75 be internally, asymmetrically constructed, yet externally, substantially symmetrically constructed. By the internal, asymmetrical construction, it is meant that the reflective surfaces within internal cavity 110 are not symmetrical. In the particular embodiment shown as discussed above, this fact is true in connection with at least the difference in construction between top and bottom walls 114 and 115. Certainly, the positioning of lighting module 148 also accounts for some of this asymmetry. Therefore, there is preferably asymmetry in connection with the internal configuration of shell 102 itself, as well as further internal asymmetry provided in connection with the inclusion of lighting module 148. On the other hand, by stating that lighting unit 75 is externally, substantially symmetrically constructed, it is meant that at least the portion of shell 102 used in connection with mounting lighting unit 75 to oven cavity 6 is symmetrical, i.e., at least the portion of lighting unit 75 which is finally positioned within the opening provided in the oven cavity wall. In connection with lighting unit 75 described above, this symmetry is exemplified through the combined configuration of first side wall portion 119 on each of side walls 116 and 117, first wall portion 145 of top wall 114 and the front most section of bottom wall 115. This external, symmetrical construction enables lighting unit 75 to be selectively, mounted to oven cavity 6 in one of multiple positions. More specifically, in the embodiment detailed above, at least the front section of main body 104 is generally rectangular in shape and, in particular, this rectangular configuration is exemplified by frontal parts of first side wall portion 119, first wall portion 145 and bottom wall 115. With a corresponding rectangular opening provided in oven cavity 6, lighting unit 75 can be readily, selectively mounted in either the position shown in FIG. 2 or the position shown in FIG. 3.

Due to the asymmetrical configuration of internal cavity 110, the level of illumination provided by lighting module 148 for oven cavity 6 will differ depending upon the selected mounting arrangement. More specifically, lighting unit 75 can be mounted in a first configuration as shown in FIG. 2 wherein angled second and third wall portions 146 and 147 are arranged in a low position, or lighting unit 75 can be rotated through a predetermined angle, i.e., 180° in connection with rectangular lighting unit 75, to assume a second configuration wherein angled second and third side portions 146 and 147 are in a higher position. With the internal asymmetrical configuration, rotating lighting unit 75 through the predetermined angle from the first configuration to the second configuration has been found to increase the level of illumination in oven cavity 6 in the order of at least 45%. Therefore, lighting unit 75 can be mounted in the position shown in FIG. 2 to provide a first level of illumination for oven cavity 6 or in a second configuration, which can be established by simply rotating lighting unit 75 through a predetermined angle from the first configuration, to achieve a second illumination level for oven cavity 6, wherein the second illumination level is different from and, more specifically, significantly higher than, the first illumination level.

Based on the above, through the present invention, it is now possible to employ a single lighting unit which is constructed in a manner which enables a manufacturer or other user to selectively alter a desired illumination level for an oven cavity by simply rotating a given lighting unit through a predetermined angle to achieve the different configurations. The invention can be used in connection with a single oven cavity size to provide a preferred degree of illumination or a common lighting unit can be employed with various ovens of different sizes, wherein the lighting unit can be mounted in the configuration shown in FIG. 2 for use in connection with a smaller oven cavity and the configuration of FIG. 3 in connection with a larger oven cavity. In any case, it is important in connection with the invention that the mounting be symmetrical for various reasons, including the ability to make a standard size opening in an oven cavity and in connection with providing a standard mounting sequence for assembly personnel. However, in accordance with the overall invention, it should be realized that various polygonal shapes for the lighting unit can be employed. For instance, the outer shell could take numerous symmetrical shapes, specifically a wide range of polygonal shapes including a square, an equilateral triangle, a hexagon, an octagon and the like. That is, it is merely necessary that the lighting unit be able to rotate prior to insertion into a side wall opening of an oven cavity, with the exhibited illumination intensity varying depending upon the selected mounting position.

Although described with respect to a preferred embodiment of the invention, it should be readily understood that various changes and/or modifications can be made to the invention without departing from the spirit thereof. In particular, it should be noted that reference terms, such as top, bottom, upper, lower and the like, have only been employed in connection with describing structure based on the lighting fixture as shown in the drawings such that these terms should not be considered limiting, particularly based on the rotatable nature of the overall lighting fixture. In general, the invention is only intended to be limited by the scope of the following claims.

What is claimed is:

1. A method of mounting a lighting unit for an oven cavity defined by a plurality of walls with at least one of the plurality of walls including an opening at which the lighting unit is to be exposed, the method comprising:

selecting a desired level of illumination for the oven cavity between at least first and second illumination levels, with the first illumination level being lower than the second illumination level; and arranging the lighting unit to be mounted in the opening of the at least one of the plurality of walls in a first configuration if the first illumination level is selected and in a second configuration, which can be established by rotating the lighting unit through a predetermined angle from the first configuration, if the second illumination level is selected.

2. The method of claim 1, further comprising: mounting the lighting unit in the second configuration.

3. The method of claim 2, wherein the lighting unit is rotated from the first configuration to the second configuration prior to being mounted in the second configuration.

4. The method of claim 1, wherein the predetermined angle is 180°.

5. The method of claim 1, wherein mounting the lighting unit includes positioning an externally, substantially symmetrically constructed outer body portion of the lighting unit into the opening formed in the at least one of the plurality of walls of the oven cavity, while exposing an asymmetrically constructed internal cavity of the lighting unit to the oven cavity.

6. The method of claim 1, further comprising: providing an increase in the order of at least 45% from the first illumination level to the second illumination level.

7. A method of mounting a lighting unit for an oven cavity defined by a plurality of walls with at least one of the plurality of walls including an opening at which the lighting unit is to be exposed, the method comprising:

determining a desired mounting configuration for the lighting unit in the opening of the at least one of the plurality of walls from at least first and second, potential mounting configurations, wherein the first and second configurations provide different levels of illumination for the oven cavity; and switching between the first and second configurations by rotating the lighting unit.

8. The method of claim 7, further comprising: mounting the lighting unit in the second configuration.

9. The method of claim 8, wherein the lighting unit is rotated from the first configuration to the second configuration prior to being mounted in the second configuration.

10. The method of claim 7, wherein switching between the first and second configurations is achieved by rotating the lighting unit through a predetermined angle of 180°.

11. The method of claim 7, further comprising: mounting the lighting unit by positioning an externally, substantially symmetrically constructed outer body portion of the lighting unit into the opening formed in the at least one of the plurality of walls of the oven cavity, while exposing an asymmetrically constructed internal cavity of the lighting unit to the oven cavity.

12. The method of claim 7, further comprising: increasing a level of illumination from the first configuration to the second configuration by at least 45%.

* * * * *